US006454600B1

(12) United States Patent
Jones

(10) Patent No.: US 6,454,600 B1
(45) Date of Patent: Sep. 24, 2002

(54) ELECTRICAL ASSEMBLY HAVING RETENTION MECHANISM THEREIN

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/938,360

(22) Filed: Aug. 23, 2001

(51) Int. Cl.[7] ..... H01R 13/73
(52) U.S. Cl. ..... 439/571
(58) Field of Search ..... 439/567, 571, 439/572

(56) References Cited

U.S. PATENT DOCUMENTS 5,316,500 A * 5/1994 Vanaleck et al. ..... 439/567
5,322,452 A * 6/1994 Mosquera ..... 439/567
5,593,307 A * 1/1997 Bale et al. ..... 439/567
6,024,603 A * 2/2000 Chen et al. ..... 439/571
6,074,249 A * 6/2000 Beken et al. ..... 439/567

* cited by examiner

*Primary Examiner*—Gary F. Paumen
(74) *Attorney, Agent, or Firm*—Wei Te Chung

(57) ABSTRACT

An electrical assembly (1) includes a first electrical element (2), a second electrical element (8) and an actuating element (3). The first electrical element has a support section (22) including a retention element (5). The retention element has a pair of spaced legs (52). The second electrical element defines a cavity (82) in a part (80) thereof. The actuating element has a resilient arm (30), a pressing arm (32), a separating element (34) and a pair of side wings (36). The actuating element is pivotally movable with respect to the retention element and facilitates the releasable lock of the legs to the cavity.

1 Claim, 19 Drawing Sheets

ELECTRICAL ASSEMBLY HAVING RETENTION MECHANISM THEREIN

BACKGROUND OF THE INVENTION

1. Field of the Invention

The present invention relates to an electrical assembly, and particularly to an electrical assembly having a retention mechanism for mechanically connecting electrical components of the electrical assembly.

2. Description of the Related Art

Electronic devices, such as a computer and its peripheral device are, as is known to all, usually kept in an electrical connection therebetween by way of an electrical connection between two complementary electrical connectors. The complementary electrical connectors are respectively mounted to the computer and the peripheral device and together constitute an electrical assembly. The electrical connection between the two complementary electrical connectors of the electrical assembly is in turn achieved with the aid of a mechanical connection provided by retention mechanisms, such as latches, of the complementary electrical connectors. The latches go out of the engagement therebetween when the electrical connection between the electrical connectors is to be canceled.

A retention mechanism such as a board lock is also, as disclosed in U.S. Pat. No. 6,074,249, often provided in an electrical assembly consisting of an electrical connector and a printed circuit board to mount the electrical connector to the printed circuit board, thereby helping to establish an electrical connection between the electrical connector and the printed circuit board. Sometimes, the board lock would be pulled out of the printed circuit board when the electrical connector is to be repaired.

However, it is often difficult for the conventional board locks and latches to be mounted to or be removed from the printed circuit board and/or the complementary electrical connector without special tools because the retention force of the retention mechanism needed to ensure the reliability of the retention therebetween is large.

Therefore, an electrical assembly having an improved retention mechanism is desired to overcome the disadvantages of the prior art.

SUMMARY OF THE INVENTION

A major object of the present invention is to provide an electrical assembly having a retention mechanism which easily connects and/or disconnects without special tools electrical components of the electrical assembly while maintaining a reliable retention between the electrical components as desired.

An electrical assembly in accordance with the present invention comprises a first electrical element, an actuating element and a second electrical element. The first electrical element comprises a retention element integrally formed therewith and pivotally assembled with the actuating element. The retention element has a pair of spaced legs and the second electrical element includes a cavity. The legs are inserted to and/or pulled out of the cavity easily with the aid of the actuating element to lock and/or unlock the first and second electrical elements.

Other objects, advantages and novel features of the invention will become more apparent from the following detailed description of the present embodiment when taken in conjunction with the accompanying drawings.

DETAILED DESCRIPTION OF THE INVENTION

Figure 1:
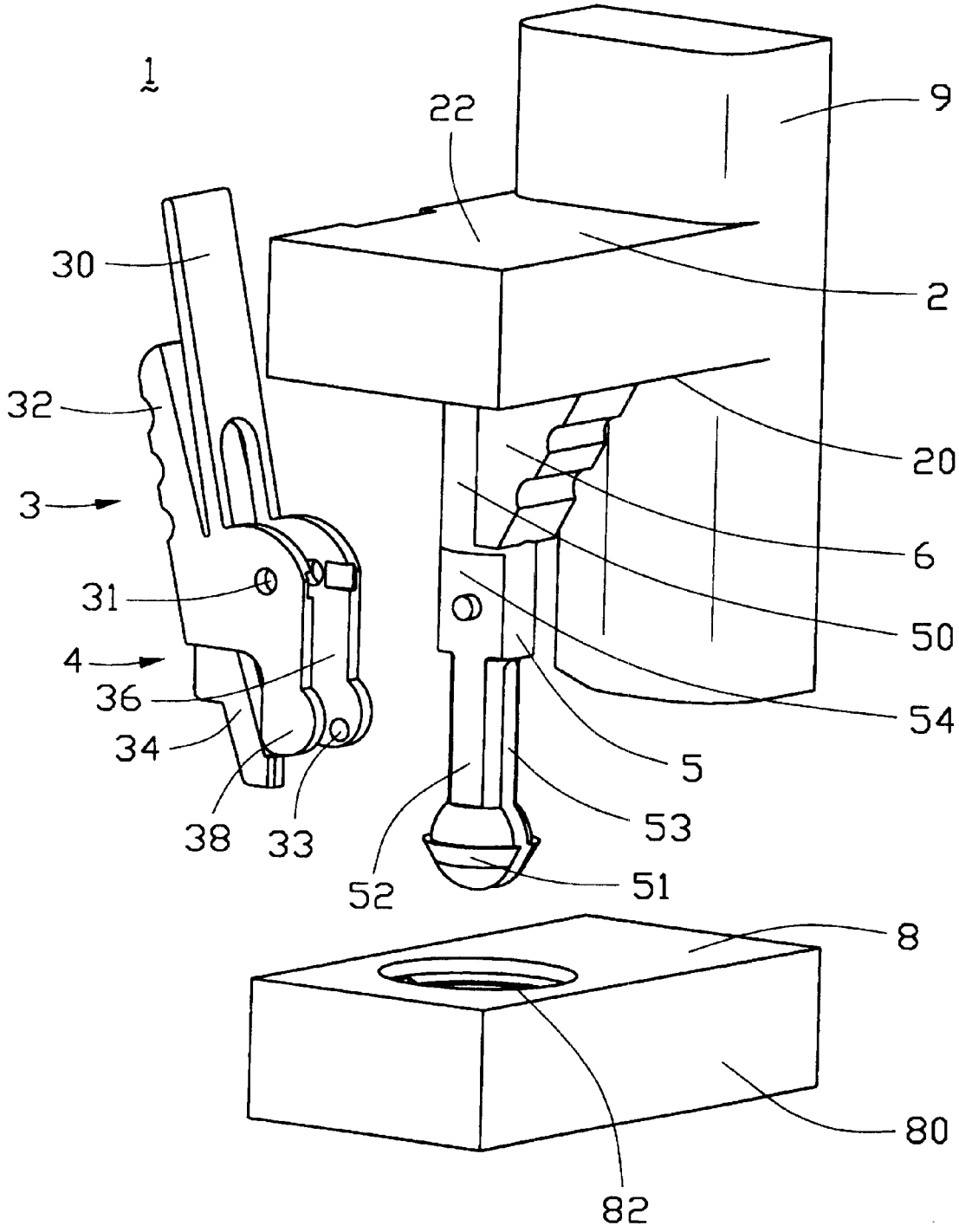
FIG. 1 is an exploded partial perspective view of an electrical assembly in accordance with the present invention.
Figure 2:
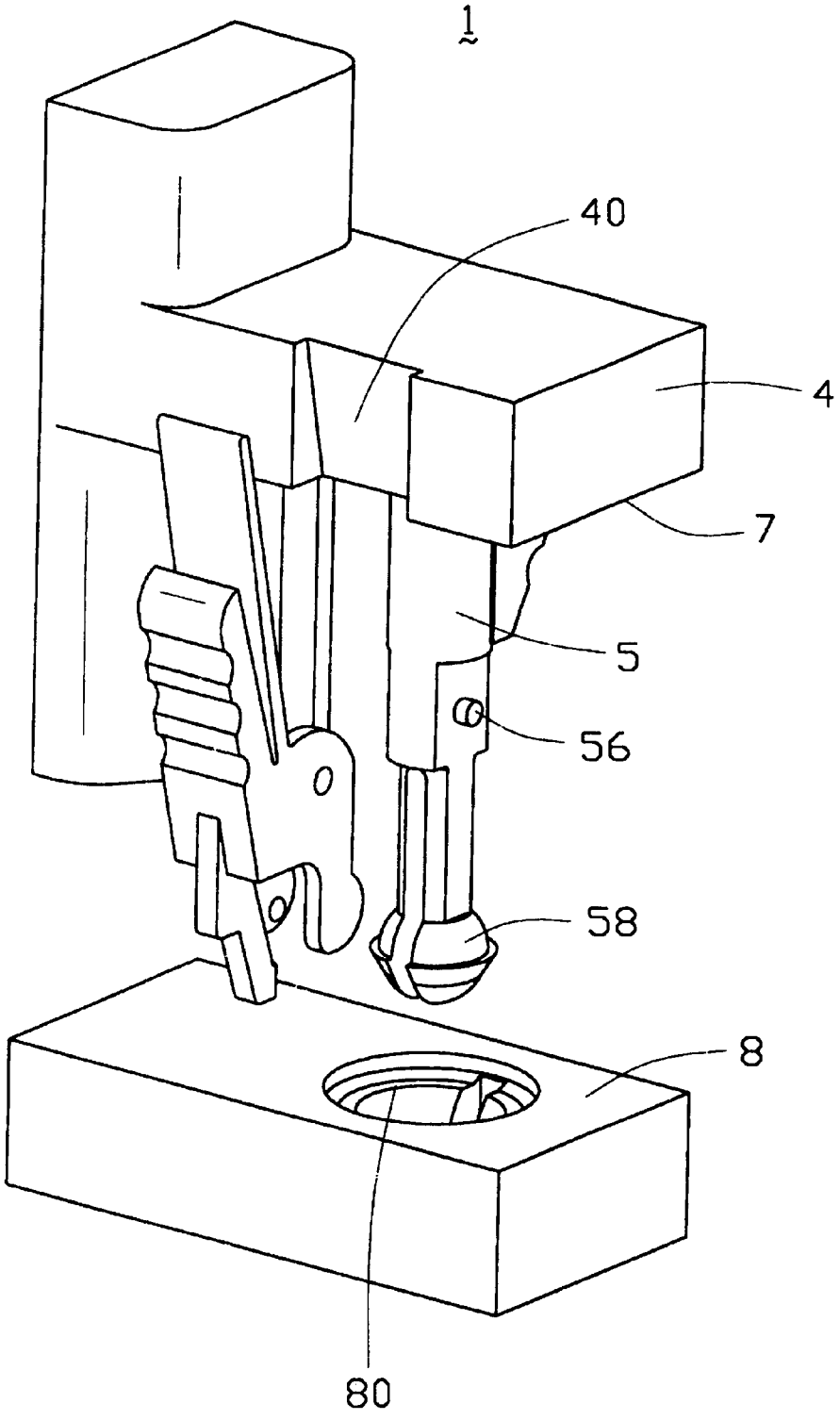
FIG. 2 is a view similar to FIG. 1 but viewed from another perspective.
Figure 3:
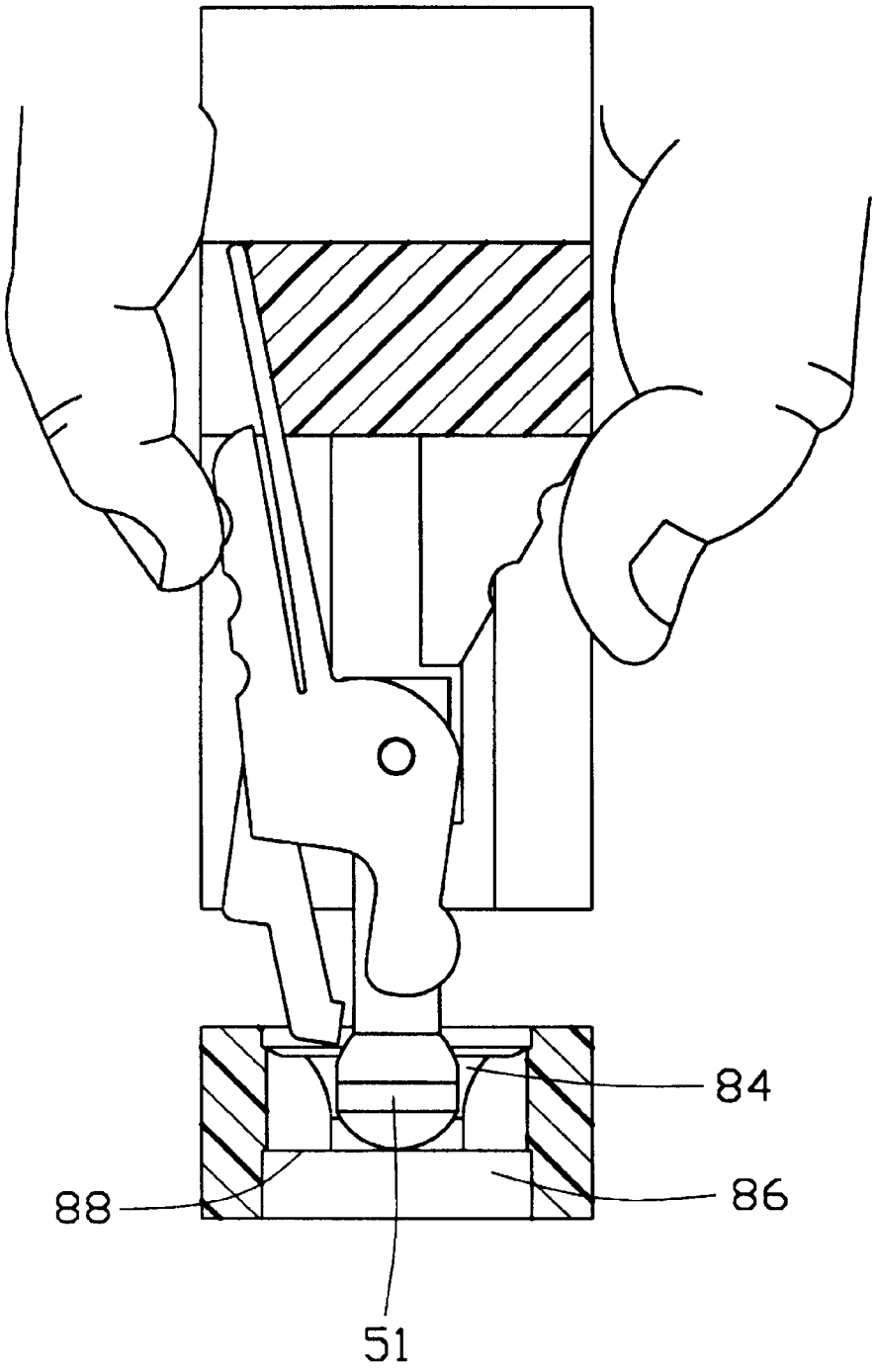
FIGS. 3, 4, 6, 7, 9 and 10 are cross-sectional views of the electrical assembly showing the process of locking.
Figure 4:
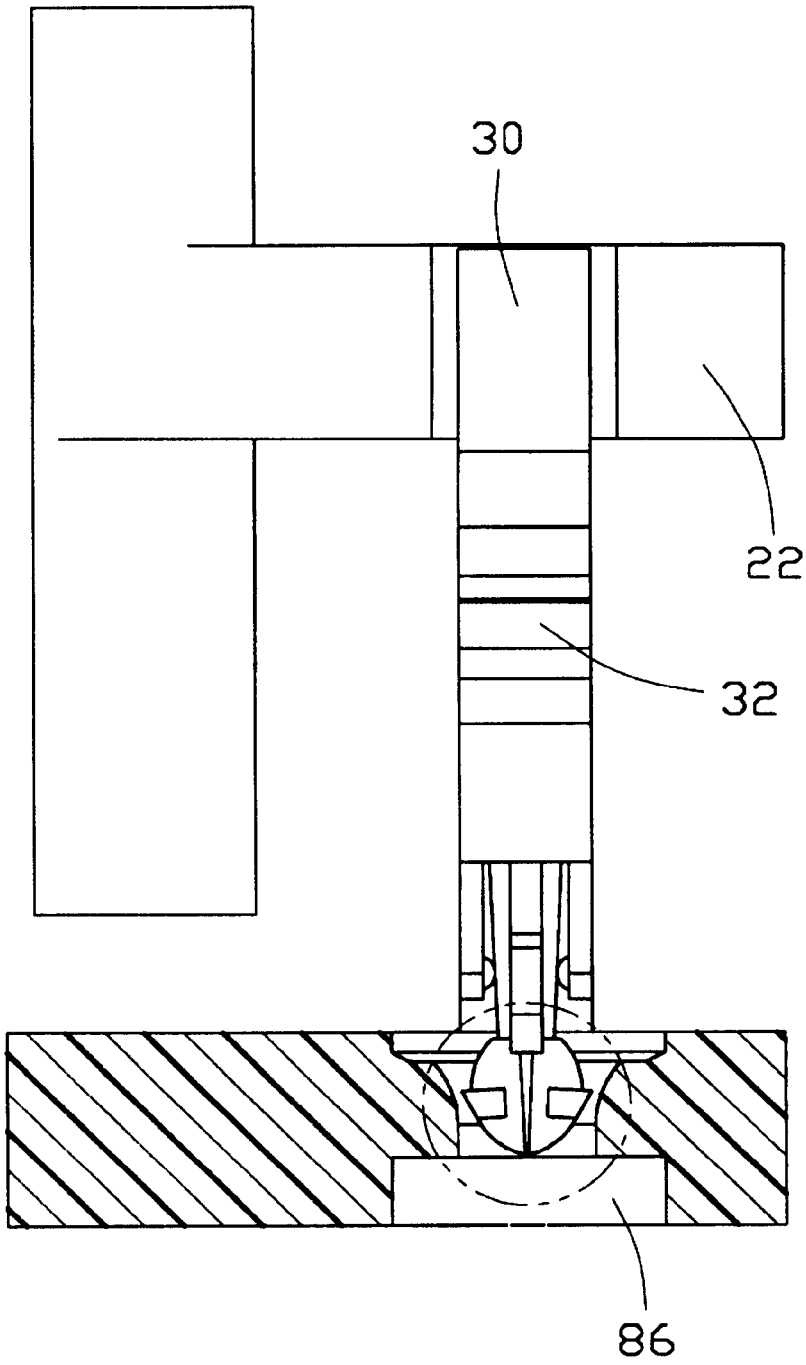
Figure 5:
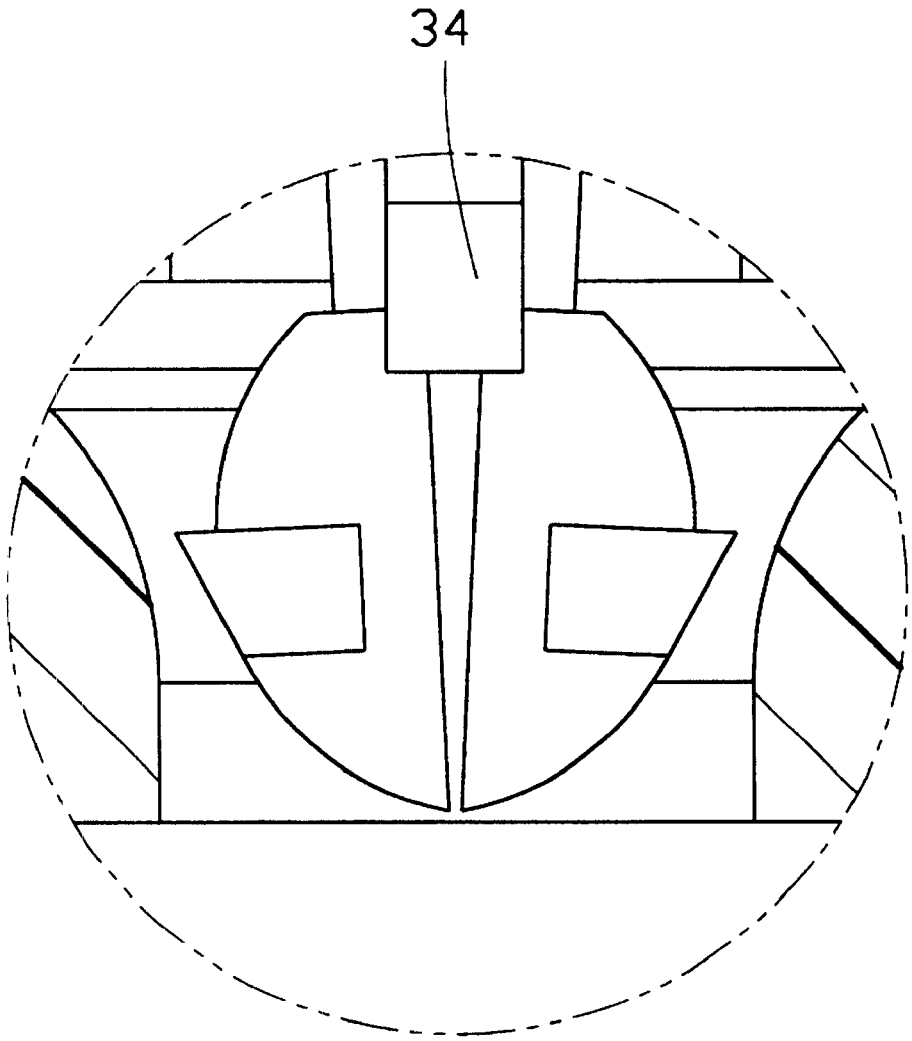
FIGS. 5, 8 and 11 are partially enlarged views taken from and marked with a circle in FIGS. 4, 7 and 10, respectively.
Figure 6:
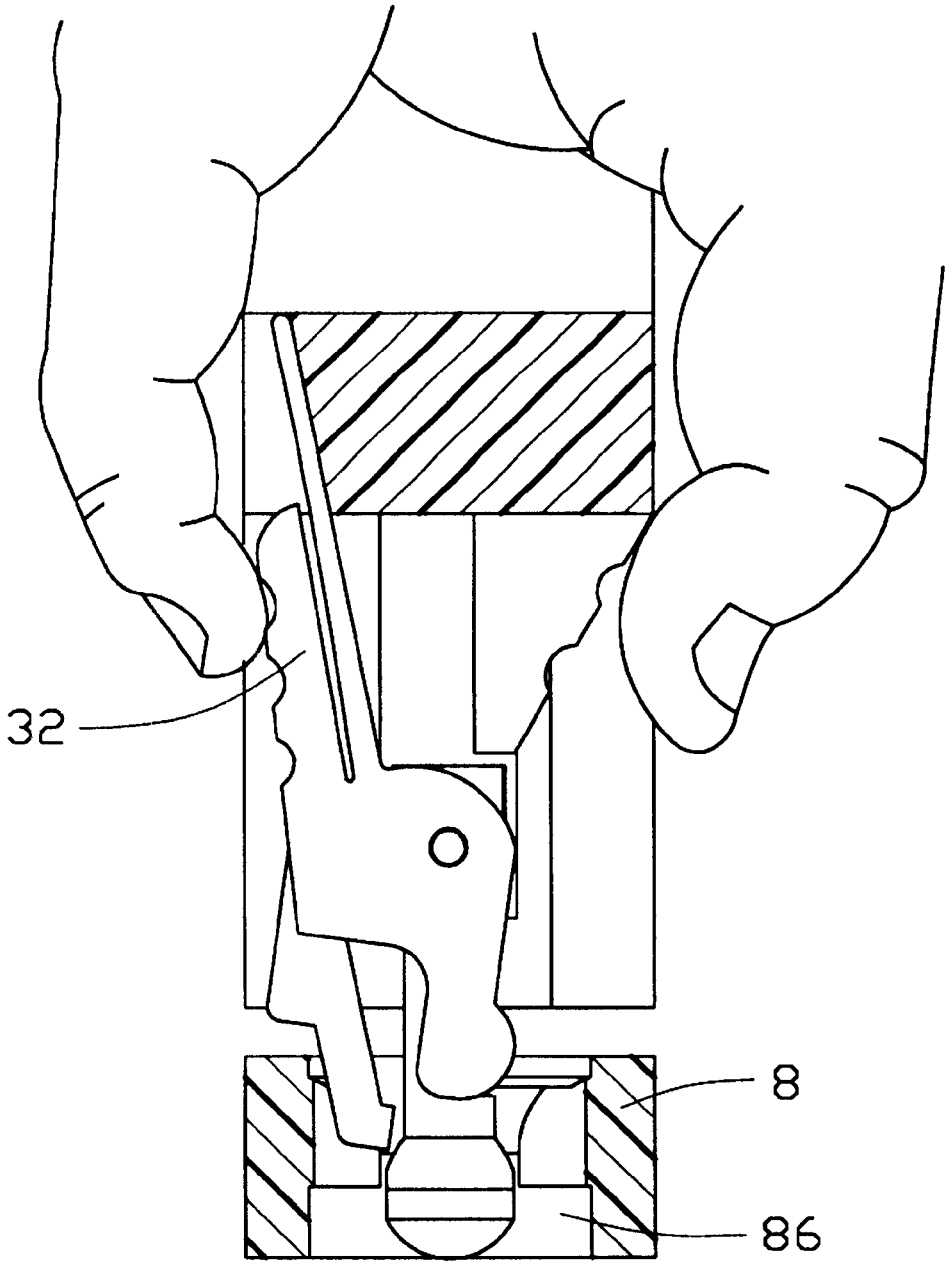
Figure 7:
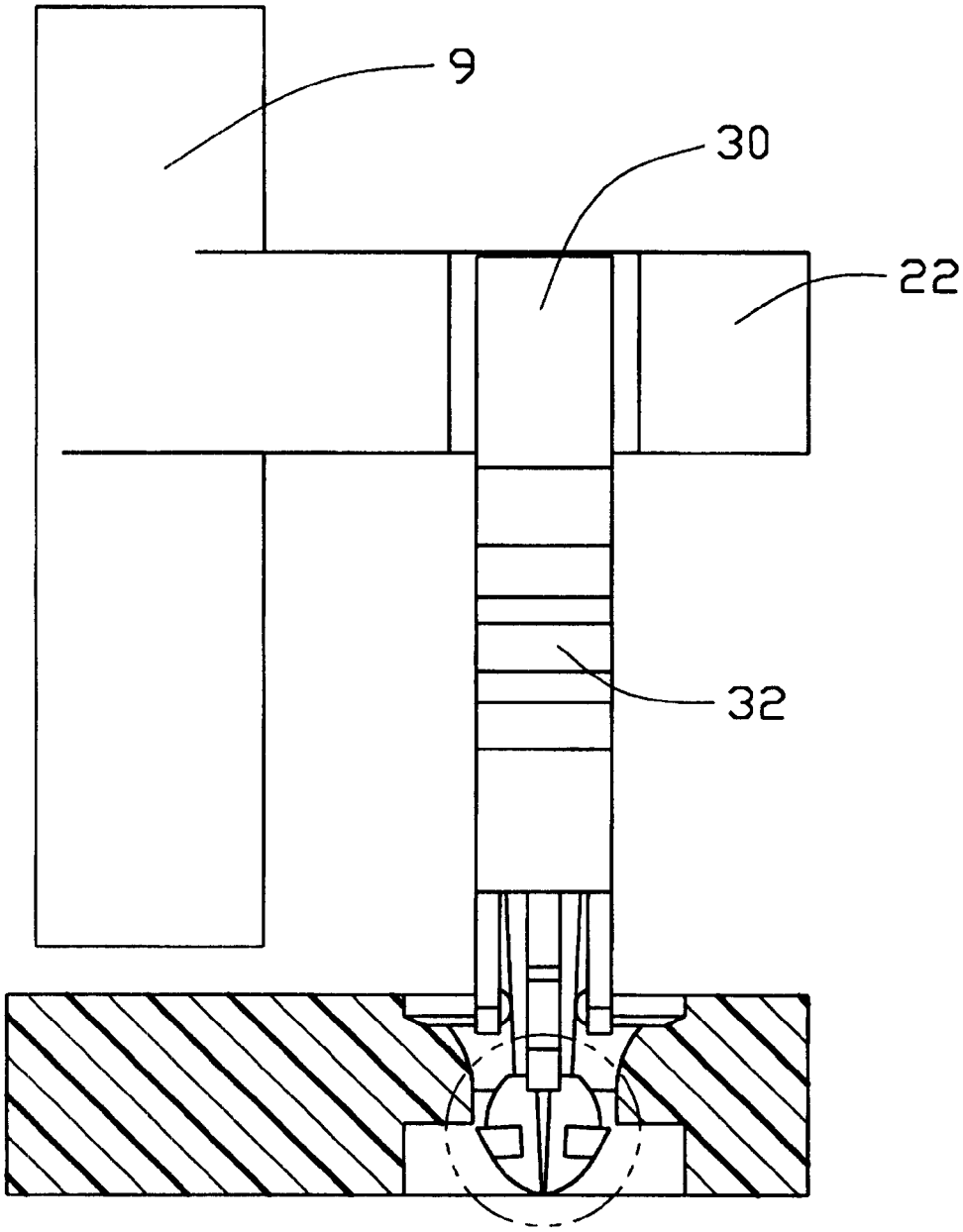
Figure 8:
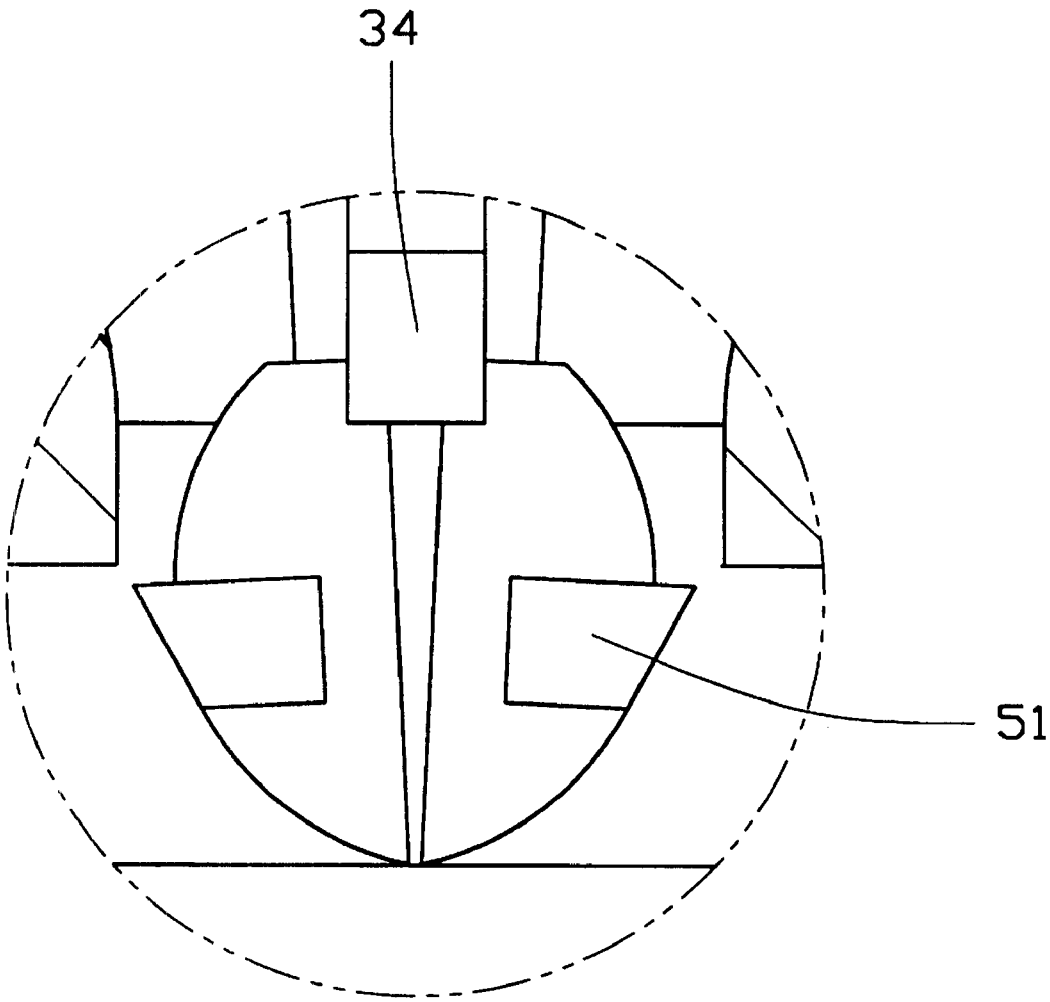
Figure 9:
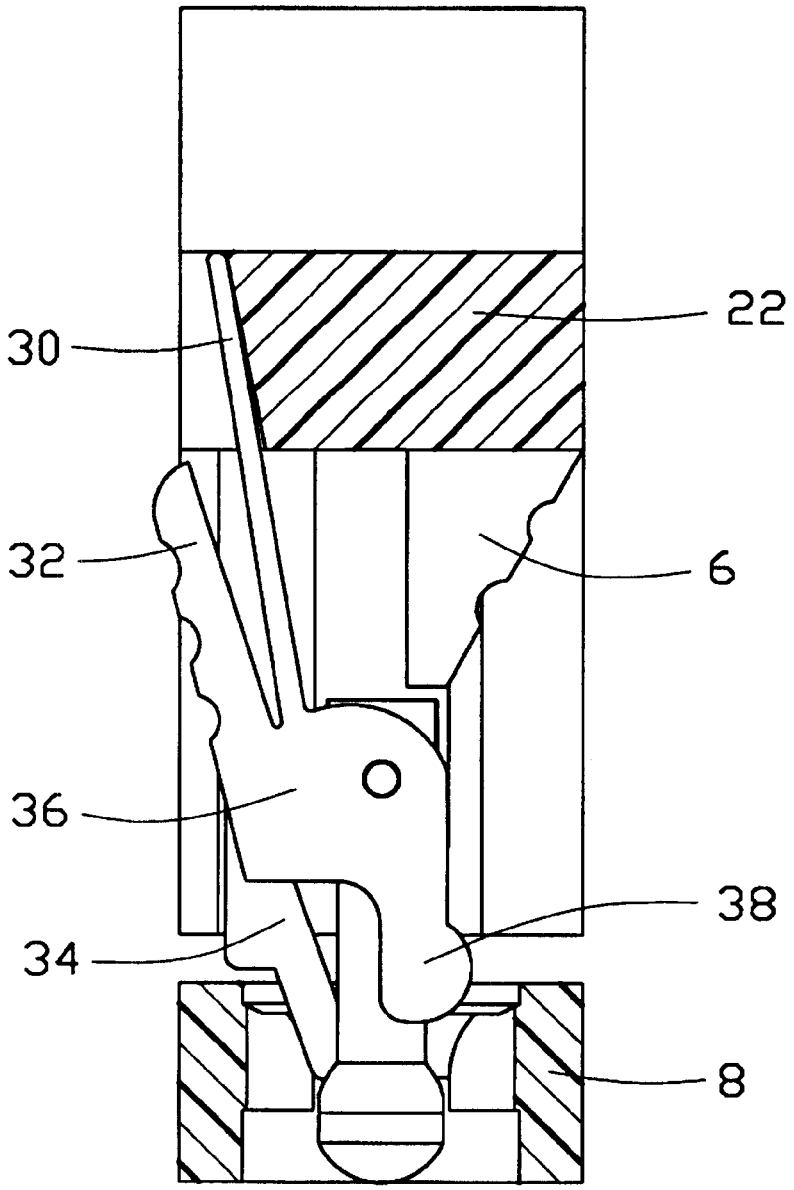
Figure 10:
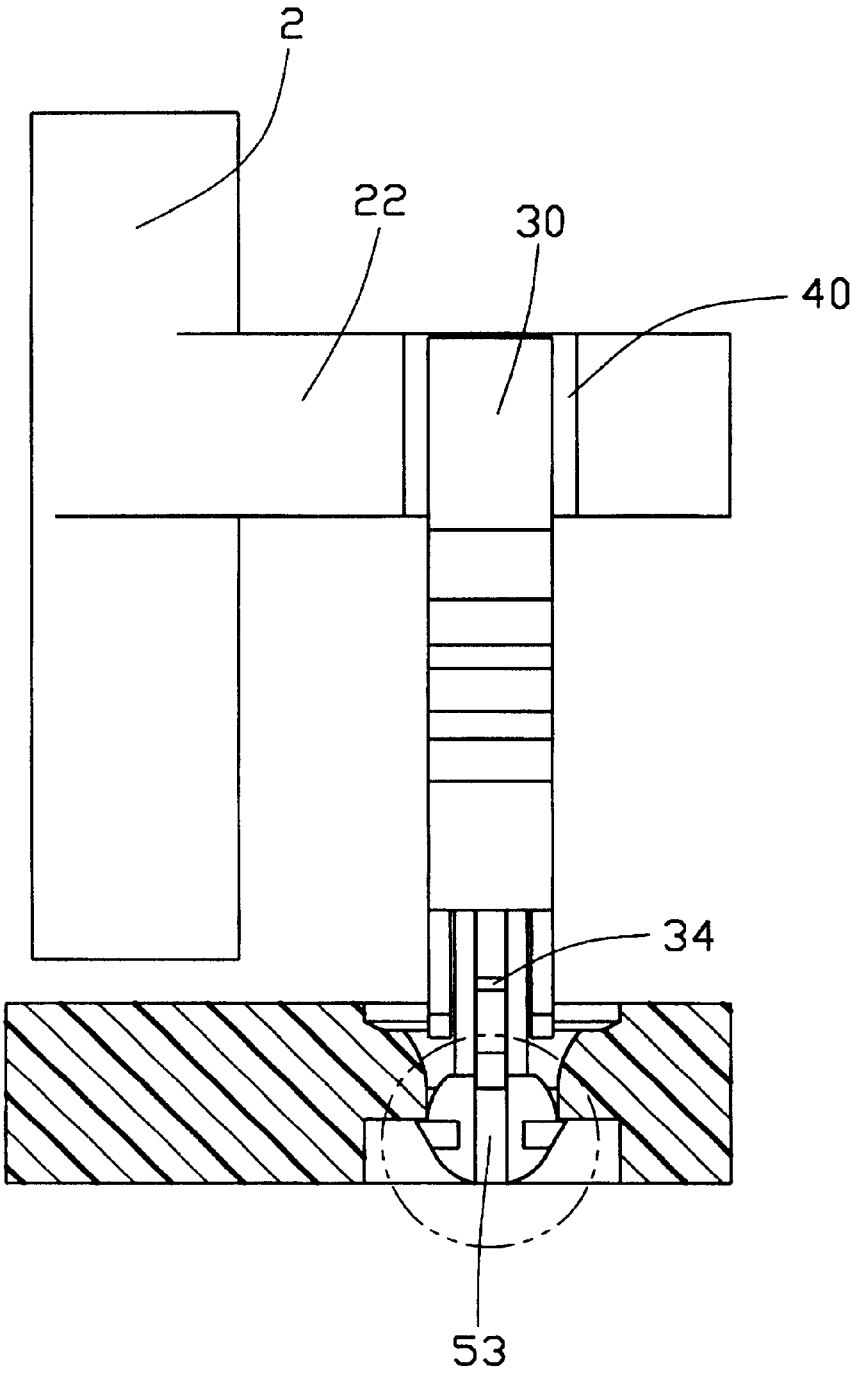
Figure 11:
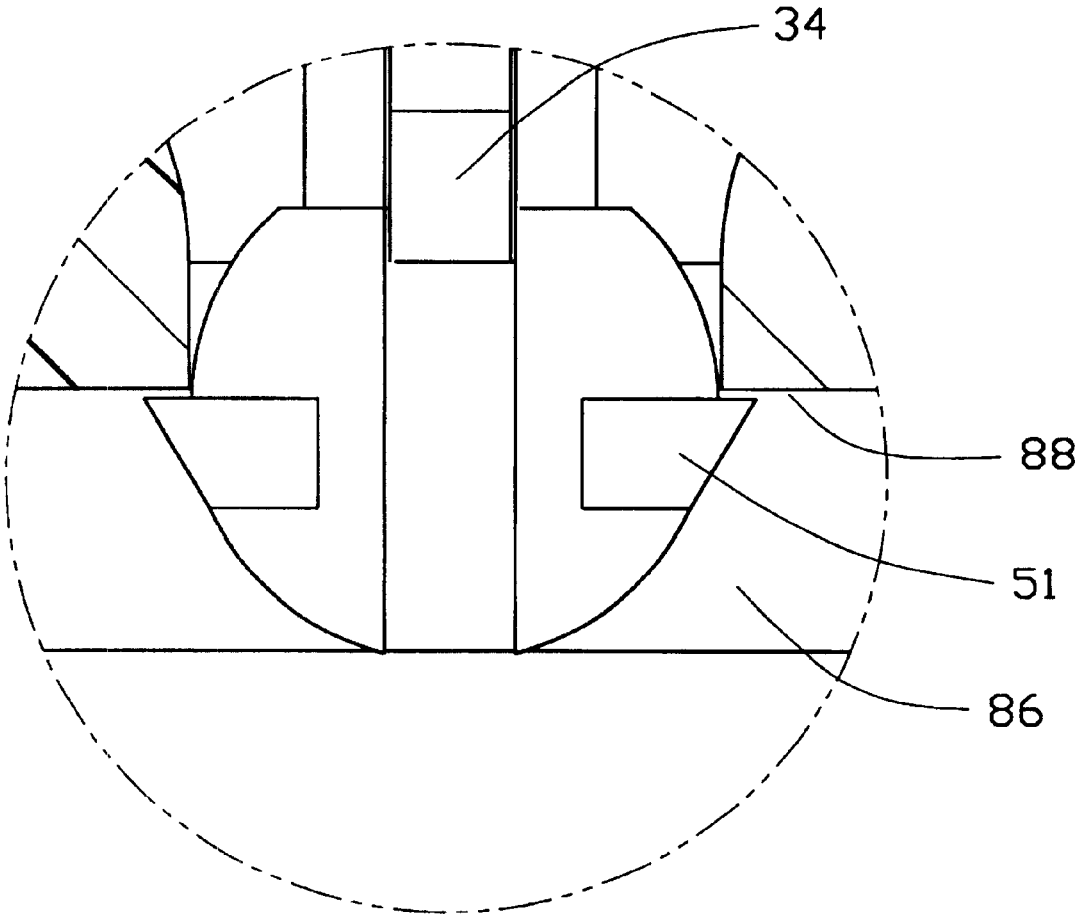
Figure 12:
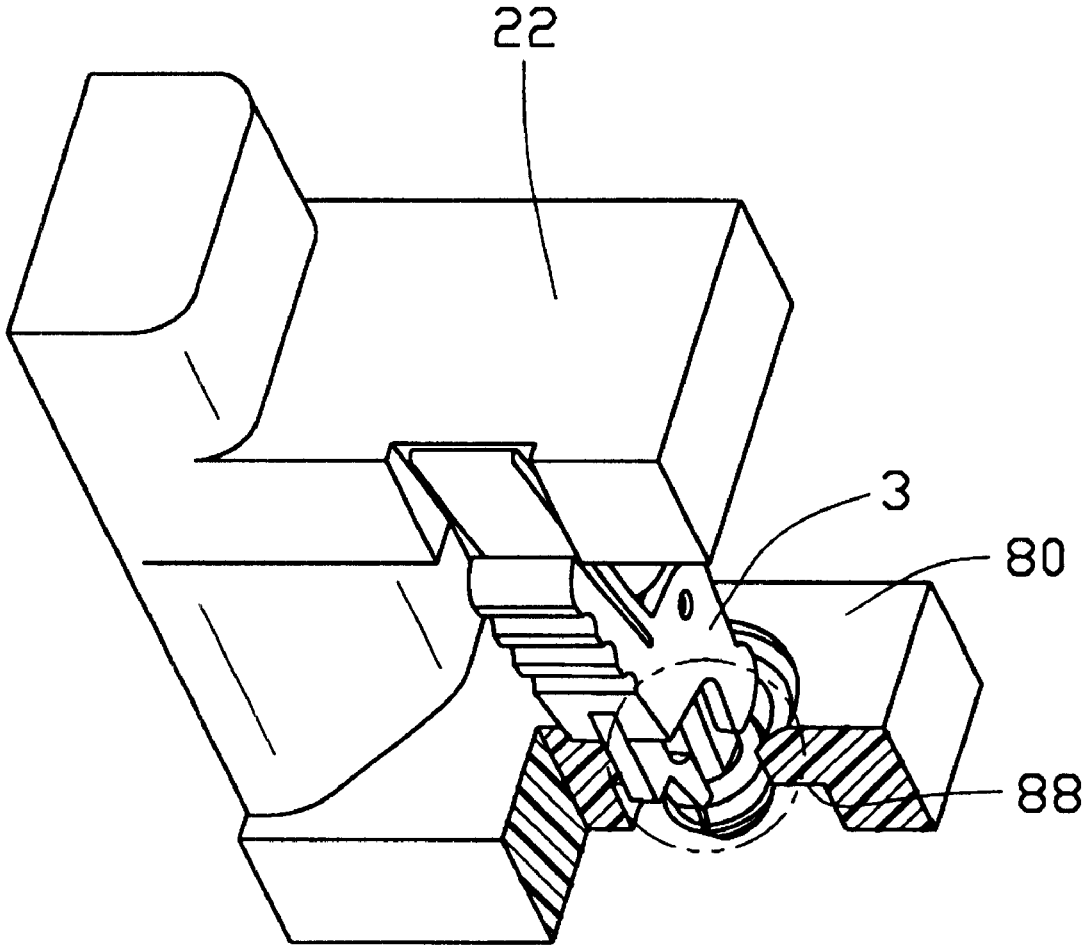
FIG. 12 is a partially cutaway view of the electrical assembly before a first and a second electrical elements of the electrical assembly are latched to each other.
Figure 13:
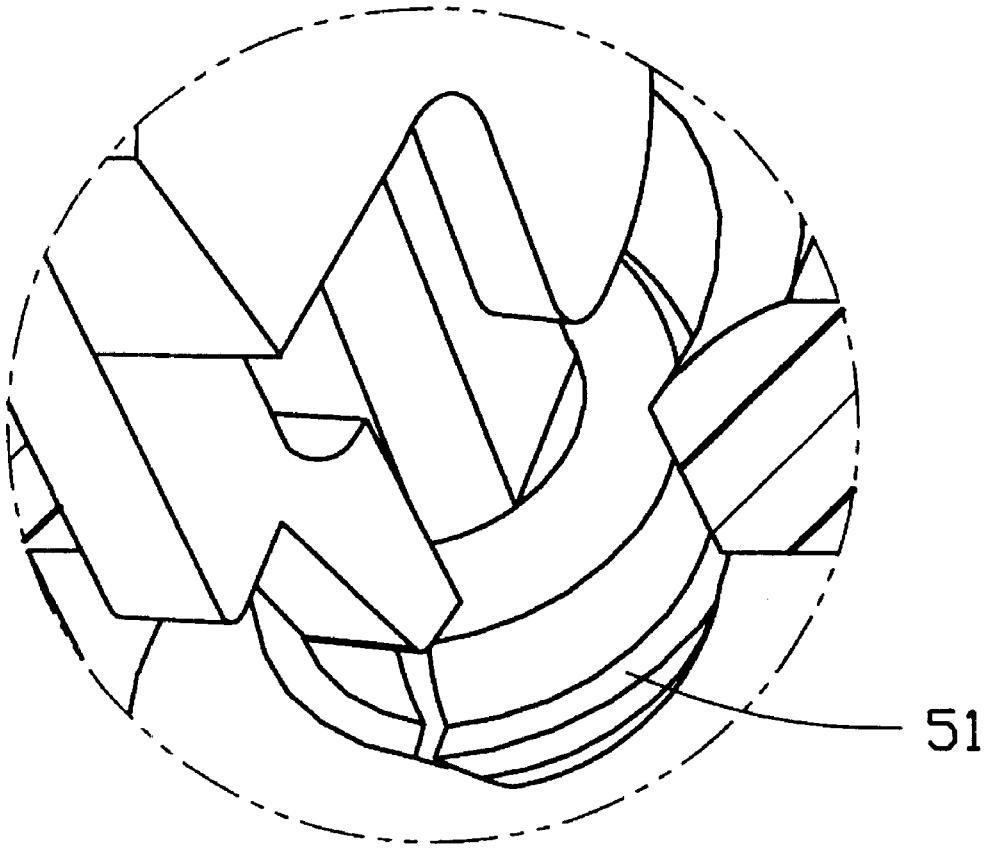
FIG. 13 is a partially enlarged view taken from and marked by a circle in FIG. 12.
Figure 14:
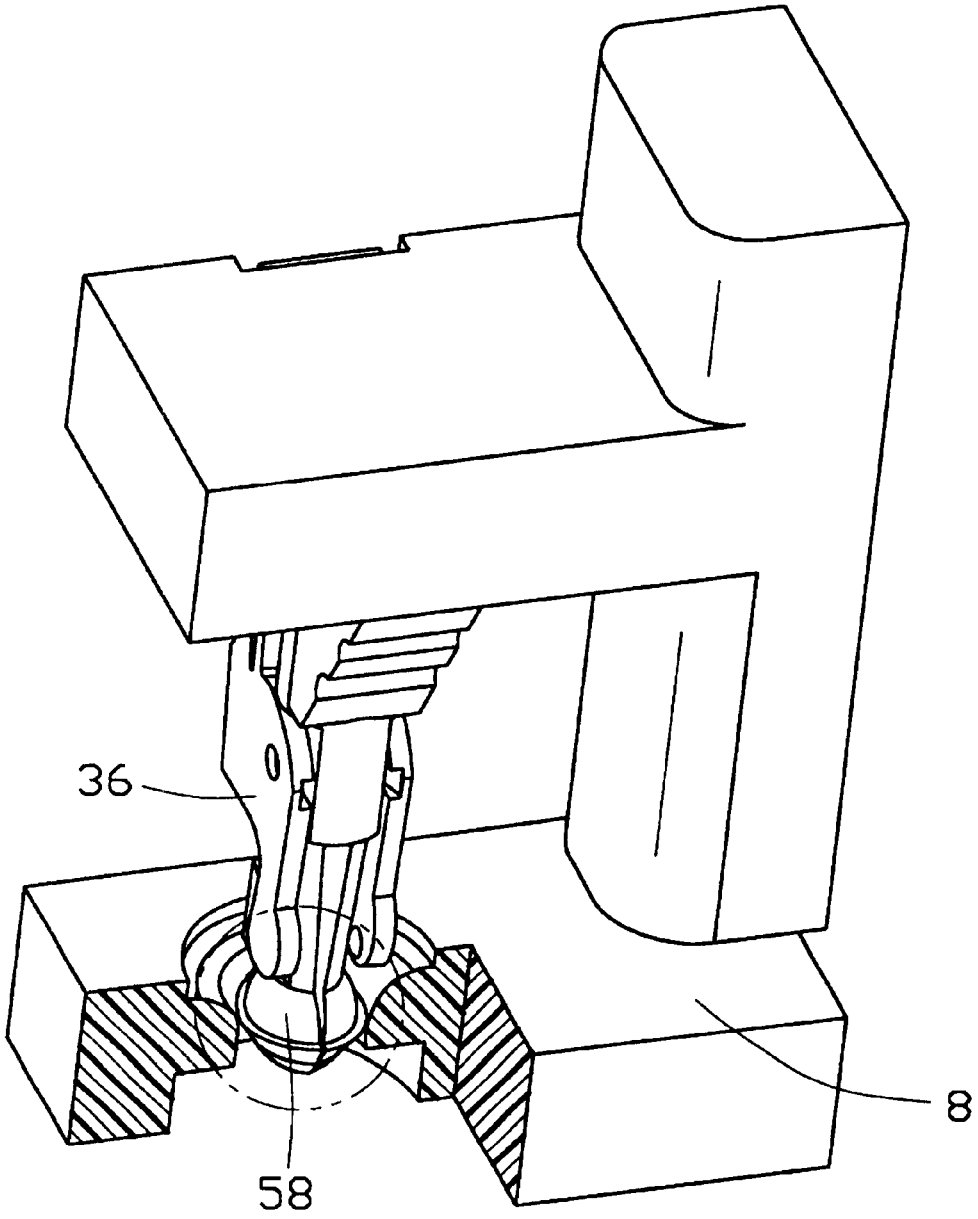
FIG. 14 is a view similar to FIG. 12, but viewed from a different perspective.
Figure 15:
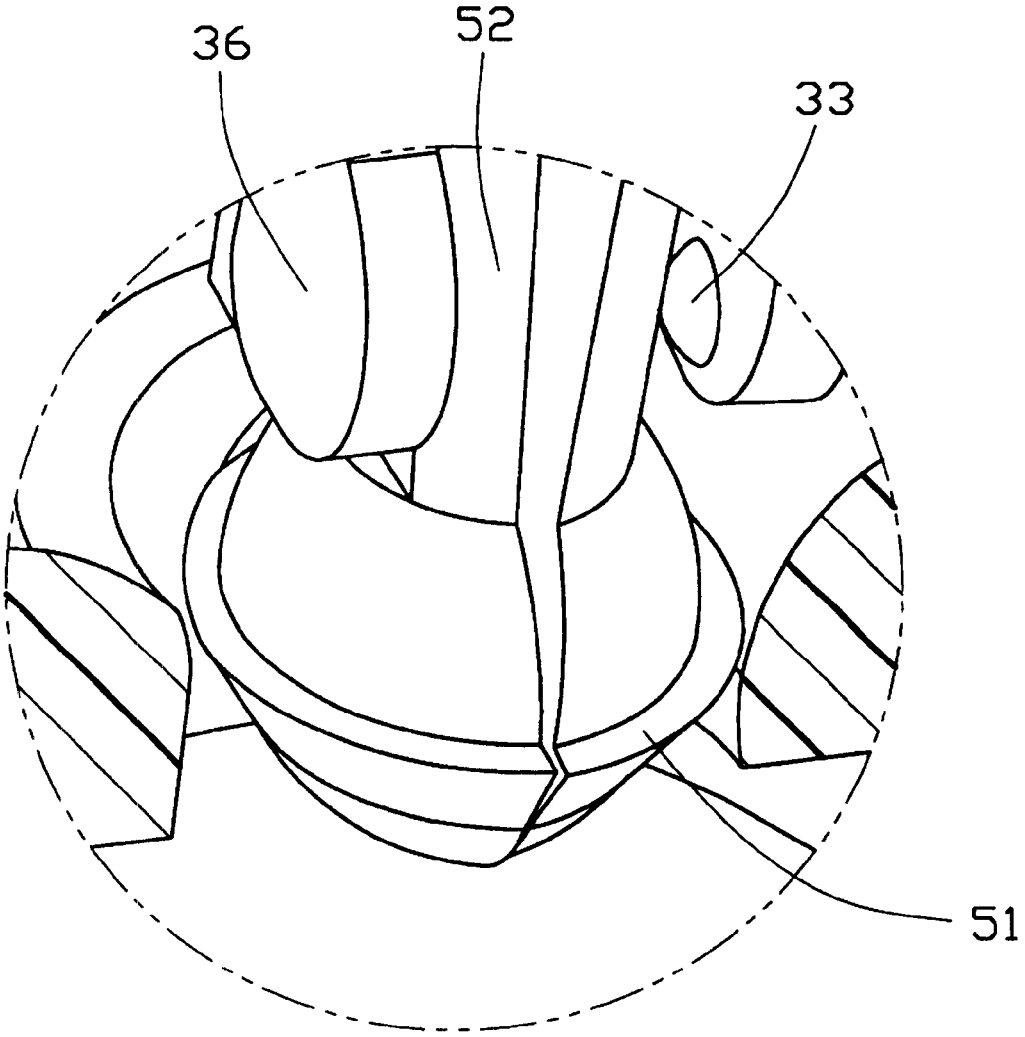
FIG. 15 is a partially enlarged view taken from and marked by a circle in FIG. 14.
Figure 16:
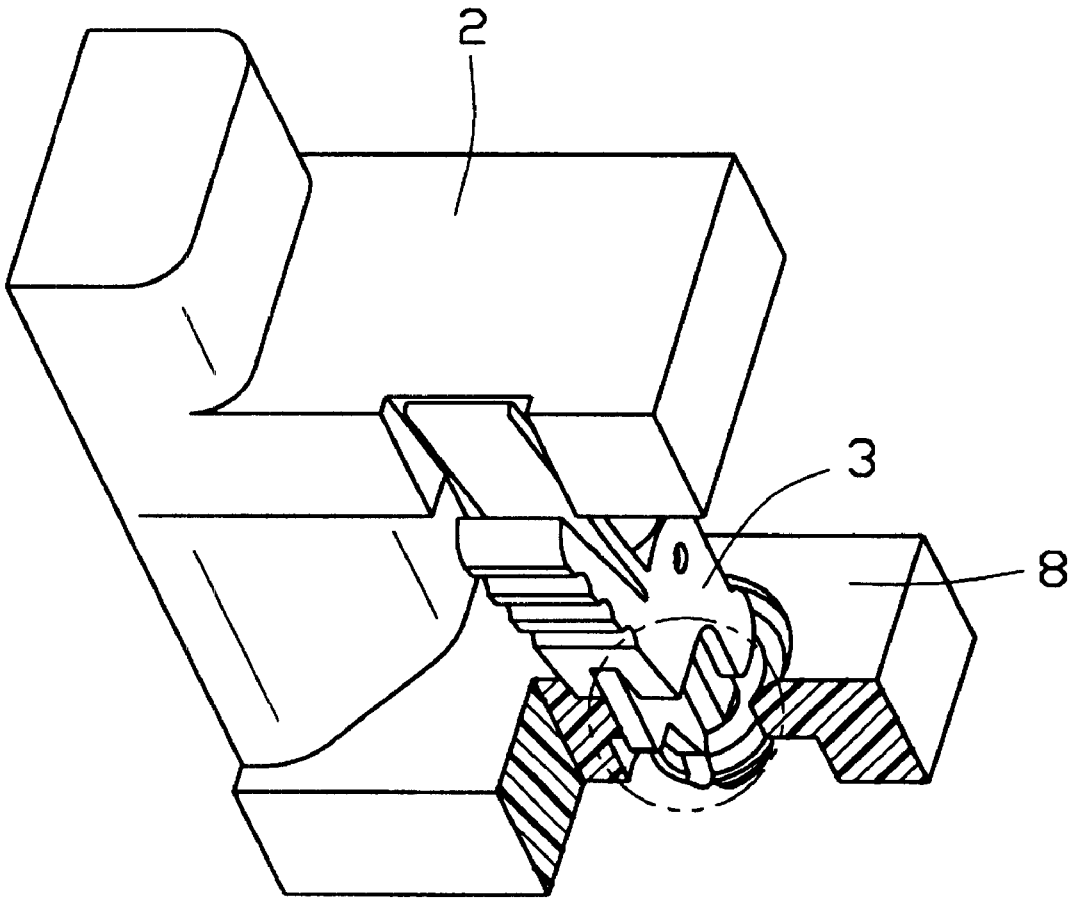
FIG. 16 is a view similar to FIG. 12 but the first and the second electrical elements have been in a latched condition.
Figure 17:
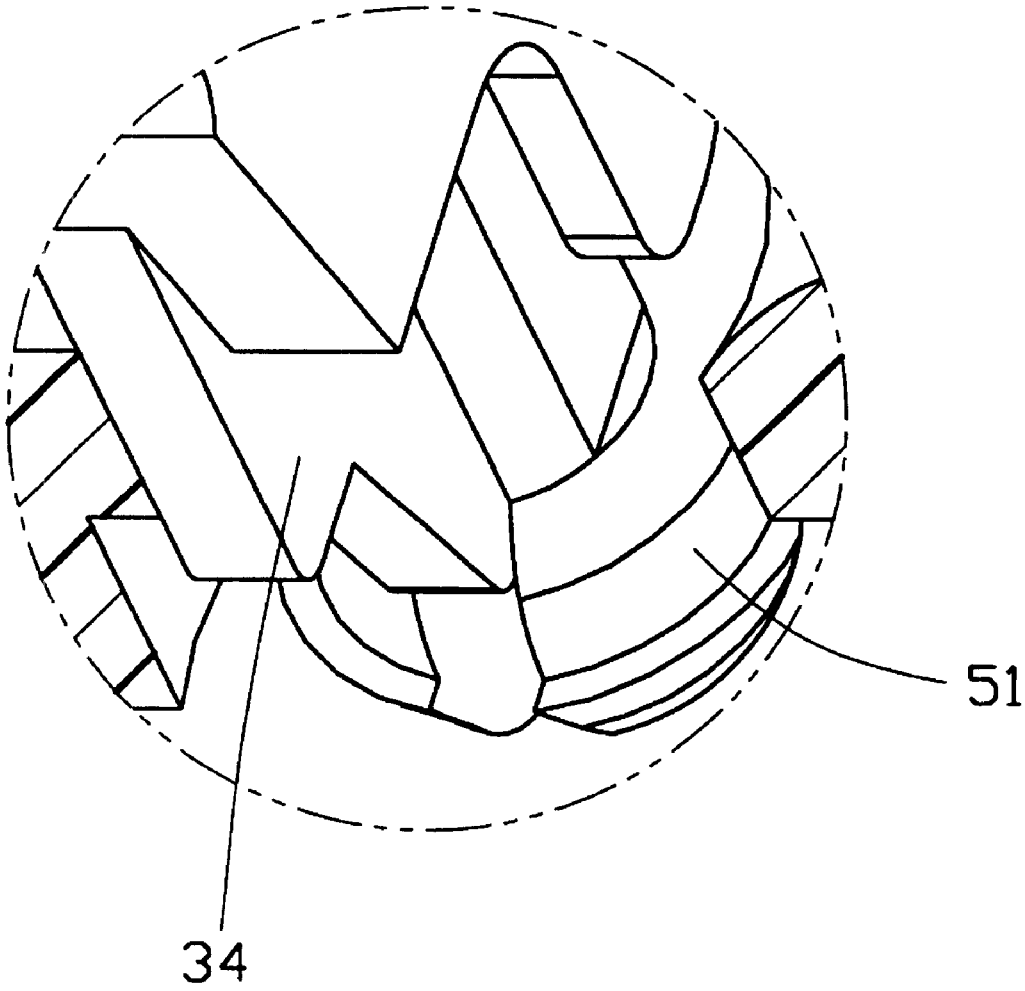
FIG. 17 is a partially enlarged view taken from and marked by a circle in FIG. 16.
Figure 18:
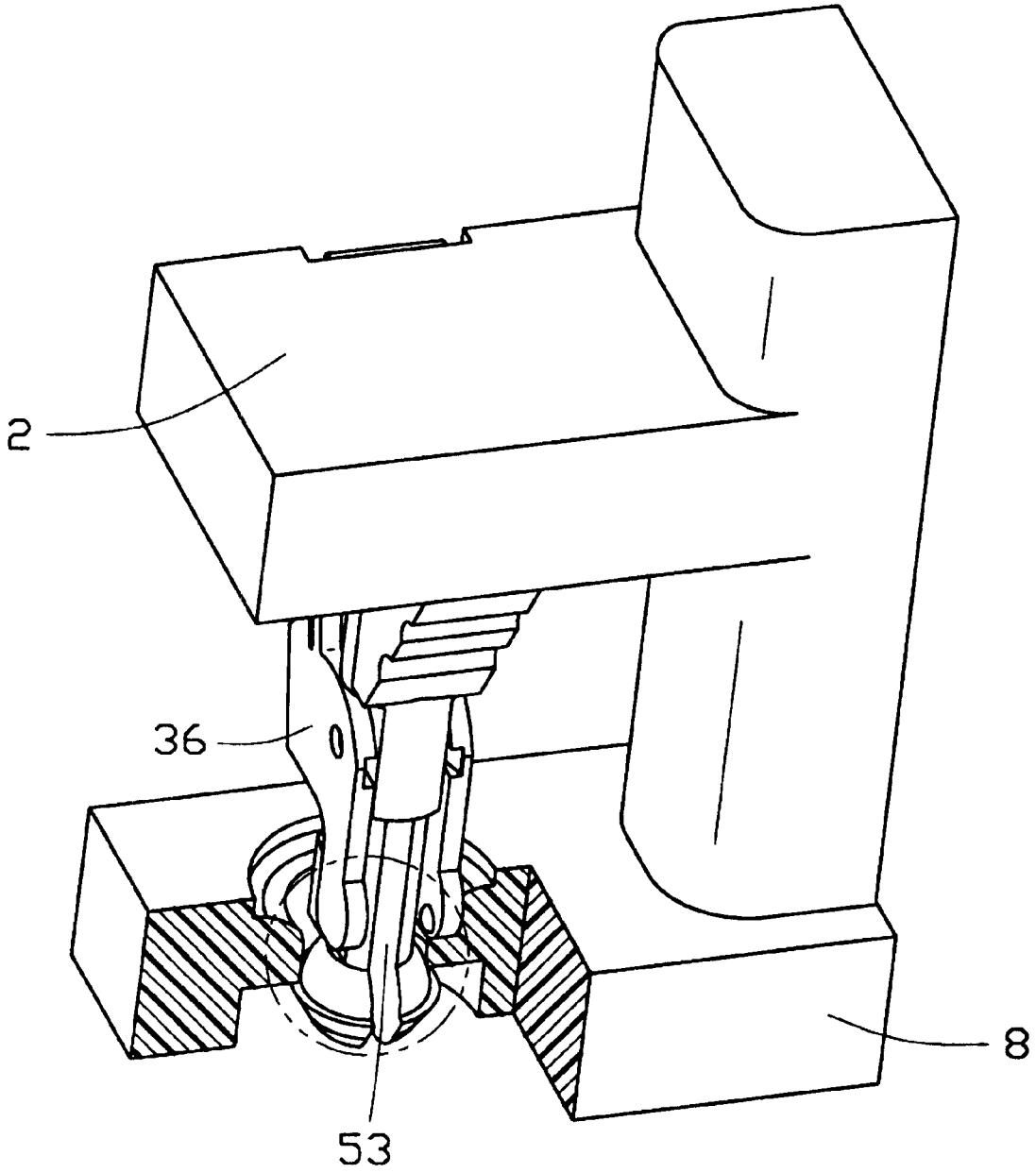
FIG. 18 is a view similar to FIG. 16 but viewed from a different perspective.
Figure 19:
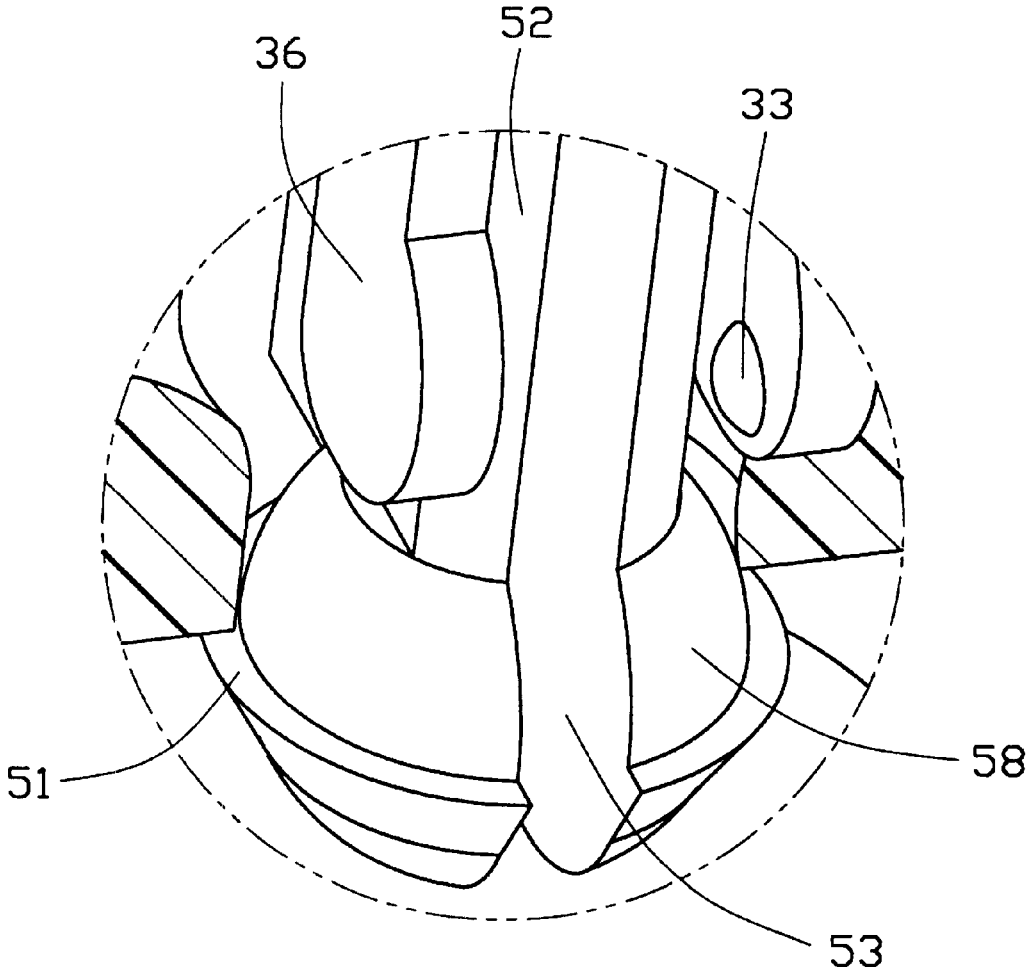
FIG. 19 is a partially enlarged view taken from and marked by a circle in FIG. 18.

Referring to FIGS. 1 and 2, an electrical assembly 1 in accordance with the present invention comprises a first electrical element 2 (only a portion thereof shown), an actuating element 3, and a second electrical element 8 (only a portion thereof shown).

The first electrical element 2 is an electrical connector in this preferred embodiment of the present invention with only a part 9 of an insulative housing thereof being shown herein. The part 9 of the first electrical element 2 has a support section 22 integrally formed therewith. The support section 22 comprises a cutout 40 defined in a side surface thereof and a retention element 5 supported thereby and integrally formed therewith. The retention element 5 comprises an upper section 50 extending perpendicularly and outwardly from a surface 20 of the support section 22, a pair of spaced legs 52, and a middle section 54 from which the spaced legs 52 extend and connecting the legs 52 with the upper section 50. The surface 20 is perpendicular to the side surface in which the cutout 40 is defined. The middle section 54 has a pair of pins 56 protruding outwardly from opposite side faces thereof. The legs 52 have a pair of enlarged sections 58 protruding outwardly from outer surfaces of lower ends thereof. Each enlarged section 58 is larger than other sections of the leg 52 with respect to size or dimension thereof and has a step section 51 having the largest dimension therein. A space 53 is defined between the legs 52. A fin 6 extends outwardly from the surface 20 and has an inner side integral with the upper section 50 and an inclinedly extending outer side opposite to the side in which the cutout 40 is defined.

The actuating element 3 is integrally formed and comprises a resilient arm 30, a pressing arm 32, a separating element 34 and a pair of opposite side wings 36 extending perpendicularly and outwardly beyond two opposite side edges of the resilient arm 30. The resilient arm 30 and the pressing arm 32 extend upwardly beyond and from between the side wings 36. A wedge-shaped space is defined between the resilient arm 30 and the pressing arm 32. Each side wing 36 includes a through hole 31 extending through an upper section thereof and a protrusion 33 protruding inwardly from an inner face of a lower end 38 thereof. The resilient arm 30 is generally in the shape of an elongated plate and is perpendicular to the side wings 36. The separating element 34 is also in the shape of a plate and is perpendicular to the resilient arm 30.

The second electrical element 8 may be a printed circuit board to which the first electrical element 2 is mounted or an electrical connector complementary with the first electrical element 2 and is shown herein with only a part 80 thereof. The part 80 defines therein a cavity or notch 82 with locking edges thereabouts. Referring to FIGS. 3–19, the cavity 82 is generally cylindrical and comprises a reception portion 84 and a retention portion 86 communicating with the reception portion 84. The retention portion 86 has a diameter larger than a diameter of the reception portion 84, thereby a shoulder 88 being formed between the reception portion 84 and the retention portion 86.

In assembly, the through holes 31 of the side wings 36 are engaged with the pins 56 of the middle section 54. The resilient arm 30 abuts against the cutout 40 of the support section 22. The separating element 34 extends into the W space 53 defined between the legs 52. In such condition, the step sections 51 of the legs 52 together constitute a larger dimension than the reception portion 84 of the cavity 82.

Referring to FIGS. 3-19, when the first electrical element 2 is intended to lock with the second electrical element 8, a pressing force is applied to the pressing arm 32 of the actuating element 3 to move the pressing arm 32 toward the resilient arm 30 while the resilient arm 30 is stopped from moving by the support portion 22. The separating element 34 and the lower ends 38 of the side wings 36 move in a direction opposite to the direction along which the pressing arm 32 moves, until the separating element 34 retreats away from the space 53 between the legs 52 and the protrusions 33 of the lower ends 38 of the side wings 36 engage with the legs 52 to press the legs 52 toward each other and to reduce the space 53 between the lower ends of the leg 52. In this way, the total dimension of the step sections 51 of the legs 52 is smaller than the dimension of the reception portion 84 of the cavity 82.

The legs 52 are then, as shown in FIGS. 3–8, inserted through the reception portion 84 of the cavity 82 into the retention portion 84 of the second electrical element 8.

The pressing force is then removed from the pressing arm 32 to cause the pressing arm 32, the separating element 34 and the side wings 36 to return to the original position due to the elasticity of the resilient arm 30. Since the protrusions 33 of the lower ends 38 of the side wings 36 no longer press the legs 52, the separating element 34 moves into the space 53 between the legs 52, and increases the total dimension of the step sections 51 of the legs 52 to cause the step section 51 being engageable with the shoulder 88 of the cavity 82, thereby retaining the enlarged sections 58 in the retention portion 86. In this way, the first electrical element 2 is reliably locked to the second electrical element 8 by the retention mechanism comprised of the actuating element 3, the retention element 5 and the cavity 82.

When the first electrical element 2 is to be unlocked from the second electrical element 8, a pressure is also applied to the pressing arm 32 to retreat the separating element 34 from the space 53 between the legs 52 thereby reducing the space 53 between the legs 52 and the total dimension of the step sections 51 of the legs 52 with the aid of the lower ends 38 of the side wings 36 and to take the legs 52 out of the cavity 80.

As described above, the locking and unlocking of the first and second electrical elements 2, 8 are easily accomplished without any special tools.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, understandably in the presently preferred embodiment, the actuating element 3 performs two functions of both deflecting the retention element 5 for easing the mating process between the retention element 5 and the cavity 82, and reinforcing the retention element 5 for latchable engagement within the cavity 82. Anyhow, other simplified embodiments having an actuator associated with the retention element for either easy mating or enhanced latching with regard to the cavity, are also feasible. For example, the retention legs may be inherently substantially smaller than the cavity diametrically, and the separating element enlarges the retention legs diametrically for enhancing latchable engagement within the cavity after the retention element is in its final locking position. Under this situation, the engagement between the side wings and the retention legs during mating for inwardly deflecting the retention legs, is unnecessary. Contrarily, for another simplified embodiment, the separating element in the presently preferred embodiment may be omitted while maintaining the engagement between the side wings and the retention legs during mating.

What is claimed is:

1. An electrical assembly comprising:

a first electrical element comprising a support section and a retention element supported by the support section, the retention element comprising a pair of spaced legs;

a second electrical element comprising a part defining a cavity therein; and an actuating element comprising a pair of side wings assembled to the retention element and engageable with the legs of the retention element to releasably lock the retention element to the cavity;

wherein the retention element extends perpendicularly from the support section and comprises an upper section, and a middle section connecting the upper section with the legs, the middle section comprising a pair of pins and the side wings of the actuating element defining a pair of through holes engaged with the pins;

wherein the side wings comprise a pair of protrusions engageable with the legs of the retention element to press the legs toward each other to release the retention element from the cavity;

wherein each leg comprises an enlarged section having a step section and the cavity comprises a reception portion, a retention portion and a shoulder engageable with the step section to retain the enlarged sections of the legs in the retention portion;

wherein the actuating element comprises a pressing arm for driving the side wings to move together therewith;

wherein the actuating element comprises a separating element driven by the pressing arm to move together with the pressing arm and the side wings to releasably engage between the legs of the retention element;

wherein the support section defines a cutout and the actuating element comprises an integral resilient arm abutting against the cutout and tending to disengage the separating element from the legs of the retention element;

wherein the first electrical element is a first electrical connector;

wherein the second electrical element is a second electrical connector complementary with the first electrical connector;

wherein the second electrical element is a printed circuit board to which the first electrical connector is mounted.

* * * * *